United States Patent [19]

Nollez et al.

[11] Patent Number: 4,761,564

[45] Date of Patent: Aug. 2, 1988

[54] ELECTRICAL CONTACTOR

[75] Inventors: Jacques Nollez, Paris; Pierre Pressaco, La Courneuve, both of France

[73] Assignee: Bendix France, Drancy, France

[21] Appl. No.: 62,753

[22] Filed: Jun. 16, 1987

[30] Foreign Application Priority Data

Jun. 18, 1986 [FR] France ..... 86 08811
Dec. 10, 1986 [FR] France ..... 86 17276

[51] Int. Cl.[4] ..... H01H 35/24

[52] U.S. Cl. ..... 307/118; 200/16 A; 200/81.4

[58] Field of Search ..... 200/1 R, 1 B, 16 A, 200/17 R, 81 R, 81.4, 81.9 R, 82 R, 82 C, 82 D, 82 DA, 153 U, 243–246; 307/10 R, 10 AT, 118

[56] References Cited

U.S. PATENT DOCUMENTS 3,688,255 8/1972 Klein et al. ..... 200/81.4 X
4,291,237 9/1981 Kitano ..... 307/10 AT
4,300,057 11/1981 Crosas ..... 307/10 AT

FOREIGN PATENT DOCUMENTS 288164 10/1915 Fed. Rep. of Germany .
1690363 5/1971 Fed. Rep. of Germany .
81280092 9/1981 Fed. Rep. of Germany .
1510980 1/1968 France .
2300408 9/1976 France .

*Primary Examiner*—J. R. Scott
*Attorney, Agent, or Firm*—Larry J. Palguta; Ken C. Decker

[57] ABSTRACT

The invention is in the field of electrical switching. The contactor includes a control member (5) which moves in translation and is placed between two bars (12) and (13) made from an electrically conducting material. The control member includes a monobloc part interposed between the two bars and has bearing surfaces (5′, 5″) enabling the control of the pivoting of the bars about axes perpendicular to the translation axis of the control member (5), to produce a sequential opening or closing of one set of pairs of contacts (8, 11) and of another set of pairs of contacts (9, 10). The invention is applicable to the control of the electrical powering of a pump to maintain the pressure of a fluid within a predetermined range.

12 Claims, 4 Drawing Sheets

ELECTRICAL CONTACTOR

The present invention relates to an electrical contactor and, more particularly, to such a contactor with manometric control which can be used in fluid pressure systems such as the hydraulic or pnuematic systems installed in a vehicle.

BACKGROUND OF THE INVENTION

Fluid pressure systems often include manometric contactors adjusted in order to respond to different pressures in order to control the operation of devices such as pumps, electro-valves, alarm or safety devices, or to control the activation of braking control systems, for example, which are particularly found in motor vehicles.

In order to reduce the number of manometric contactors present in such systems, contactors have been produced which are capable of responding to several pressure values. French Pat. No. 2,300,408 describes such a contactor which, in particular, includes a sudden break contact equipment of "bistable" type whose trigger position does not correspond to the same displacement (and therefore pressure) values in both directions of displacement. The contactor described thus enables the regulation of the fluid pressure in a circuit between these two values by controlling the starting and stopping of a pump included in the circuit at each end of the differential pressure range thus defined.

Even though such a contactor can be satisfactory in certain applications, it should be noted that the accuracy of the pressure range limits that it defines depends strictly on the production quality of a bistable type spring, particularly of its cutting, its modulus of elasticity, etc. In other applications in which attempts are made to adjust accurately the pressure range limits, independently of each other, it may not be possible to achieve satisfaction with the capabilities of a contactor of the type described in the abovementioned patent.

There is known from the German Pat. No. DE-A-1,690,393 a double break electrical contactor including at least one contact bridge that is movable in translation and in rotation so that the two contacts of a same bridge close successively. This contactor, designed to improve the closing and braking capabilities of double break electrical devices, is not designed to provide the sequential closing of more than two pairs of contacts at separate times, as a function of three fluid pressure levels for example.

It is therefore an object of the present invention to provide an electrical contactor including at least three pairs of electrical contacts whose trigger conditions (from the open state to the closed state or vice versa), can be accurately adjusted according to a sequence determined by the development of a physical value such as a fluid pressure, for example.

It is also an object of the present invention to provide such a contactor associated with manometric means to control a pump acting on the pressure of a fluid in order to maintain this pressure within a predetermined range, by changing over the state of a pair of electrical contacts at each of the two limits of this range.

Another object of the present invention is to provide such a contactor, capable of controlling not only a fluid pump so that the pressure of the fluid is maintained within a predetermined range, but also signalling devices sensitive to the passing of the fluid pressure through a predetermined pressure value situated outside of this range, in order to then transmit an alarm signal.

These objects of the invention are achieved, together with others which will appear hereafter, with an electrical contactor of the type including a control member which moves in translation in order to pass through at least first, second and third positions each corresponding to the change of state of at least first, second, third and fourth pairs of electrical contacts which can be open or closed, first and second bars which carry first and second, and third and fourth electrical contacts respectively forming part of the first and second, and third and fourth pairs of contacts respectively, the control member working in conjunction with these bars in order to make each of them turn about an axis of rotation perpendicular to the axis of translation of the control member in such a way that at each of the ends of a rotational travel, each bar changes the state of one of the pairs of electrical contacts associated with this bar, this contactor being charcterized in that the control member includes a monobloc part interposed between the two bars which are weighted towards each other and towards this part which includes at least two bearing surfaces each placed facing one of the bars in order to act on the latter and to make it swing through a rotational travel about an axis passing through a pair of contacts, the member being movable between these two bars in order to sequentially trigger the change of state of the four pairs of contacts, at the ends of the rotational travels of the bars, when it moves from one end to the other of its translational travel.

According to another feature of the invention, the position of the control member depends on the pressure of a fluid by means of a manometric component. The contactor according to the invention is then used to adjust the pressure of this fluid such that it remains within a predetermined pressure range, by an appropriate control of a pump for the pressurizing of this fluid.

The contactor also enables, in such an application, the control of the activation or deactivation of a device, such as a computer, associated with a fluid pressure system.

BRIEF DESCRIPTION OF THE DRAWING

Other features and advantages of the contactor according to the invention will appear on reading the following description with reference to the accompanying drawings in which.

DESCRIPTION OF THE PREFERRED EMBODIMENTS

Figure 1:
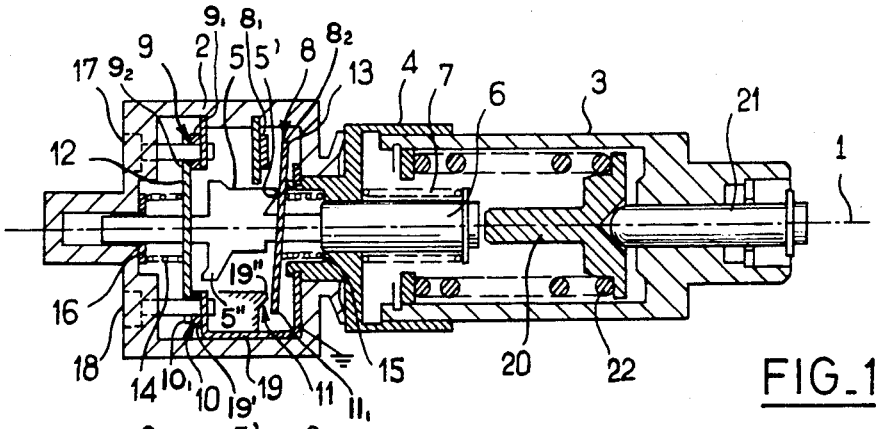
FIGS. 1 to 4 are axial cross-sectional views of the contactor according to the invention, showing four different states of this contactor.

Reference is made to FIG. 1 in which it appears that the contactor according to the invention has a generally cylindrical shape and with a longitudinal axis referenced 1. The contactor is formed from a housing 2 and an actuating cylinder 3 connected by a coupling endpiece 4. The housing 2 contains a monobloc control member 5 slidably mounted along the axis 1. The control member 5 is integral with an axial rod 6 which penetrates into the coupling endpiece 4, where it is weighted towards the right by a compressed helical spring 7. The control member 5 acts on four pairs of electrical contacts 8, 9, 10 and 11. The respective pairs of electrical contacts are as follows: pair 8 comprises contacts $8_1$ and $8_2$; pair 9 comprises contacts $9_1$ and $9_2$; pair 10 comprises contacts $10_1$ and 19'; and pair 11 comprises contacts $11_1$ and 19''. In the inactive position of FIG. 1, it appears that the pairs of contacts 8 and 11 are make-contact ones while the pairs of contacts 9 and 10 are break-contact ones. Each of the respective four pairs of contacts ($8_1$, $8_2$; $9_1$, $9_2$; $10_1$, 19'; $11_1$, 19'') is formed from an electrical contact ($8_1$, $9_1$, 19', 19'') integral with the housing 2 while the other contact ($8_2$, $9_2$, $10_1$, $11_1$) is carried by a moving bar. The contactor includes two such bars, referenced 12 and 13 respectively, each bar carrying at each end of its ends an electrical contact forming one contact of the respective pair of of the four pairs of contacts. The contacts of a same bar are electrically connected to each other because each bar is made from an electrically conducting material. Compressed helical springs 14, 15 weight the bars 12, 13 towards each other. An electrical contact 16 is centered on the axis of the control member 5, between the wall of the housing 2 and the spring 14 in order to be electrically connected to the bar 12 by means of the spring 14. Adjustment screws diagrammatically shown at 17 and 18 enable adjustments of the position of the contacts integral with the housing 2, in the pairs of contacts 9 and 10 respectively, for purposes that will be described hereafter.

Figure 2:
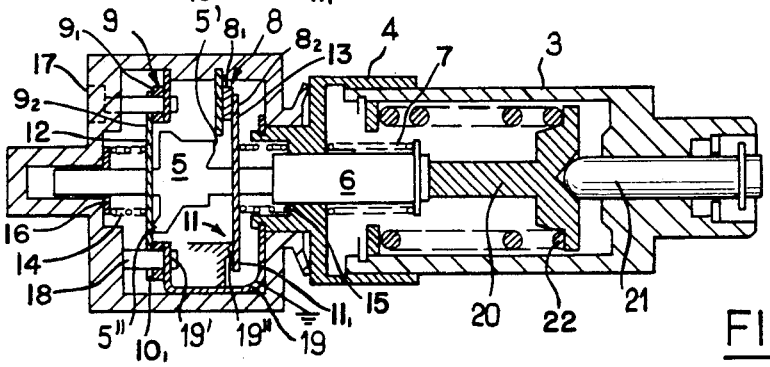

A metal part 19, fitted against the base of the housing, is electrically connected to ground. This part 19 has two protrusions or abutments 19', 19'' each of which forms one of the two contacts of the respective pairs of contacts 10 and 11, see FIG. 2.

As has been seen above, the control member 5 moves in translation along the axis 1. It is moved to the left by the thrust of a piston 20 contained in the actuating cylinder 3, this piston 20 itself working in conjunction with a control rod 21 which pushes the piston to the left, from the point of view of FIG. 1. The position of this control rod on the axis 1 can be, for example, dependent on the pressure of a fluid. In the position shown in FIG. 1, the piston 20 bears on the end of the control rod 21, under the action of a spring 22 operating in compression. In this position, the left end of the piston 20 remains separated from the right end of the rod 6 which is integral with the control member 5.

In FIG. 1 it is clear that a bearing surface 5' of the control member pushes the bar 13 back, against the action of the spring 15 operating in compression, in such a way as to prevent the closing of the pairs of contacts 8 and 11. It will be noted that, in this position, the bar 13 is inclined to the axis 1 in such a way that the distance separating the contacts of the electrical contact pair 8 is greater than the distance separating the contacts of the electrical contact pair 11. At the same time the bar 12 closes the respective contact pair 9 and 10 under the action of the spring 14 operating in compression, the control member 5 then being separated from the bar 12 in order to have no effect on the latter.

If, starting from the state of the contactor shown in FIG. 1, the pressure in the fluid which controls the axial position of the rod 21 increases, the piston 20 pushes the rod 6 which is integral with the control member 5 towards the left and this separates the bearing surface 5' formed on the control member, from the bar 13 which then begins to move to the left under the thrust of the spring 15. With the pressure continuing to increase, the contact pair 11 close, and, starting from this time, if the pressure continues to increase, the bar 13 pivots about an axis perpendicular at contact 19'' to the axis 1, so that its other end 13 approaches, under the action of the spring 15, the fixed contact $8_1$ of the pair of contacts $8_1$, $8_2$, until the closing of these contacts, see FIG. 2. The contact pair 8 and 11 are thus grounded by means of the part 19. This grounding takes place at the moment at which the predetermined pressure is reached in the fluid which controls the movement of the rod 21. The closing of the contact pair 8 and 11 can then be used to apply power to an electrical or electronic device associated with the fluid pressure system fitted with the connector according to the invention, as will be seen hereafter with reference to FIG. 5.

Figure 3:
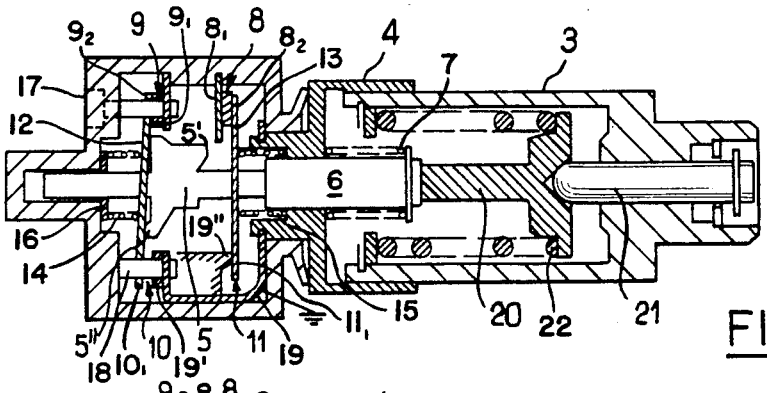

With pressure in the fluid continuing to increase, the control rod 21 and the control member 5 continue their movement to the left, from the point of view of the drawing, until a second bearing surface 5'' (see FIG. 2) of the control member 5 starts to push the bar 12, at a second determined pressure value, in order to open the contact pair 10 without, however, opening the contact pair 9. According to the invention, this result is obtained by shaping the control member in such a way that the bearing surface 5'' protrudes to the left (from the point of view of the drawing) of the left surface of this member (see FIG. 3). Thus, when this bearing surface 5'' starts to bear on the bar 12 in the neighborhood of the contact pair 10, the control member makes the bar 12 turn about an axis perpendicular to the axis 1 and centered on the pair of contacts 9, in order to open the pair of contacts 10. This rotation of the bar 12 continues until this bar comes to rest in a state of stability on the left surface of the control member 5, as shown in FIG. 3.

Figure 4:
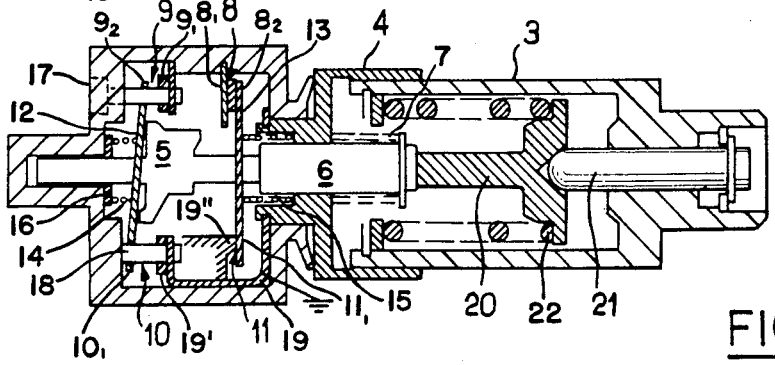

If the pressure of the fluid in the controlled system then continues to increase, the bar 12 then moves in translation parallel to the axis 1, carried by the control member 5, which causes the opening of the pair of contacts 9 for a third predetermined pressure value (see FIG. 4).

In the opposite direction, if the pressure then begins to decrease, the respective contact pairs 9 and 10 will successively reclose. The closing of these contacts can be used to control the electrical power supply of a pump placed in the fluid circuit of the controlled system in such a way as to maintain the presssure of the fluid within a pressure range whose limits are determined by the values for which the control rod 21 causes, by means of the control member 5, the opening or the closing of the respective contact pairs 9 and 10. Similarly, a large pressure drop in the system, accidental for example, will cause the opening of the pairs of contacts 8 and 11 and therefore the switching off of the electrical or electronic device mentioned above.

According to the invention, adjustment screw 17 and 18 enable adjustment of the position of the fixed contact of the pairs of contacts 9 and 10 by a simple distortion of this fixed contact. This enables the adjustment, independently of each other, of the pressure levels corresponding to a change in state of the pairs of contacts 9 and 10. In this way the position and the width of the controlled pressure range can be adjusted. Even though not apparent in the drawing, the fixed contact $8_1$ of the pair of contacts $8_1$, $8_2$, could, of course, be fitted with the same means of adjustment.

Figure 5:
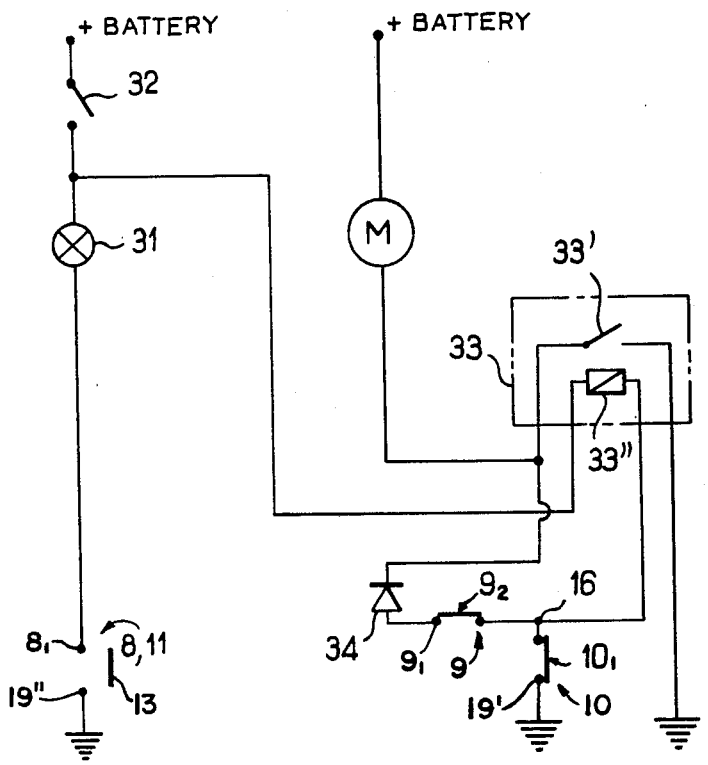
FIG. 5 shows a part of a fluid pressure control circuit which includes a contactor according to the invention.

Reference is now made to FIG. 5 which shows part of an electrical control circuit of a fluid pressure device making use of the contactor according to the invention. In this figure, the various electrical contacts have the same numerical reference as those appearing in FIGS. 1 to 4, which show the contactor according to the invention, in order to facilitate understanding of the operation of the circuit. The fluid pressure device can, for example, be used to operate the brakes of a motor vehicle. Such a device includes a fluid circuit in which there is a pump operated by an electric motor M powered by the vehicle battery. The device also includes an audible and/or visual alarm component 31 connected in series with a switch 32 controlled by the vehicle ignition key and electrically connected to the vehicle battery. The set of contact pairs 8, 11, define a make-contact switch placed between the alarm component and ground.

The motor of the pump is controlled by a make-contact relay 33. The coil 33'' of the relay is connected on the one hand to the common point of the switch 32 and the alarm component 31 and, on the other hand, to the common contact 16 of the sets of contact pairs 9 and 10 defining break-contact switches. A diode 34 is placed between the pair of contacts 9 and the common point of the power supply lead of the motor M and the switch 33' controlled by the coil 33'' of the relay 33. This diode prevents the current coming from the motor M from flowing to ground through the sets of contact pairs 9 and 10. It is clear that the contact pairs 8, 11, 9, 10, and contact 16 are brought together in a contactor according to the invention, in accordance with the corresponding references in FIGS. 1 to 4.

The circuit in FIG. 5 reacts to the pressure in the controlled fluid circuit passing through three pressure values $P_1$, $P_2$, and $P_3$ which are increasing in this order. On starting the vehicle, the switch 32 closes and the coil 33'' of the relay is powered in order to close the swtich 33' which powers the pump motor. The pressure in the fluid circuit then begins to increase under the action of the pump. When this pressure passes through the value $P_1$, the contact pairs 8, 11 close to power the alarm component 31. With the pressure then continuing to increase to the value $P_2$, the break-contact switch of contact pair 10 opens in order to disconnect the break-contact switch of contact pair 9 from ground without, however, interfering with the operation of the pump. In fact, the current passing through the coil 33'' of the relay can flow to ground by passing through the pair of contacts 9 and the diode 34 as well as through the switch 33' of the relay itself. With the pressure continuing to increase, the electrical contact pair 9 opens when this pressure reaches the value $P_3$. The relay 33 is then de-energized and the switch 33' opens in order to cut off the power to the pump motor. The pressure in the fluid circuit then begins to drop again and when this reaches the value $P_2$, the electrical contact pair 10 closes again in order again to energize the coil 33'' of the relay 33, which has the effect of again closing the switch 33' and of restoring the supply to the pump. This supply causes the pressure to rise again to the value $P_3$ where the electrical contact pair 9 again opens so that this pressure falls again and thus remains within the pressure range bounded by the values $P_2$ and $P_3$.

As has been seen above, the values $P_1$, $P_2$, and $P_3$ can be independently adjusted by varying the position of the contacts, for example using adjustment screws.

It will be noted that with the circuit of FIG. 5 and the contactor of FIGS. 1 to 4, if the pressure in the fluid circuit drops again, for example accidentally, below the value $P_1$, the computer is automatically switched off and the driver is informed of this fact only by the switching off of the lamp, a phenomenon which he can fail to notice because it is not a positive signal, i.e. a signal perceived by an emission of energy, sound or light for example, capable of attracting the driver's attention. The switching off of the computer is an event which must, however, be brought to the attention of the driver for safety reasons as the behavior of the vehicle in a braking period is modified by it. In general, a drop in the fluid pressure in the braking circuit below a certain level must be signalled to the driver as it can indicate a failure, a leak for example, which demands an emergency stop.

Figure 6:
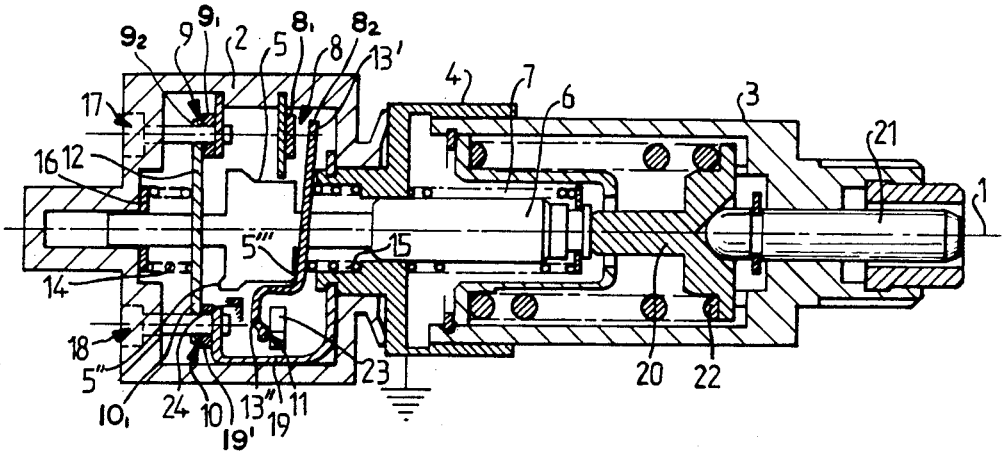
FIGS. 6 to 8 are similar views to those of FIGS. 1 to 4, of a second embodiment of the contactor according to the invention.
Figure 7:
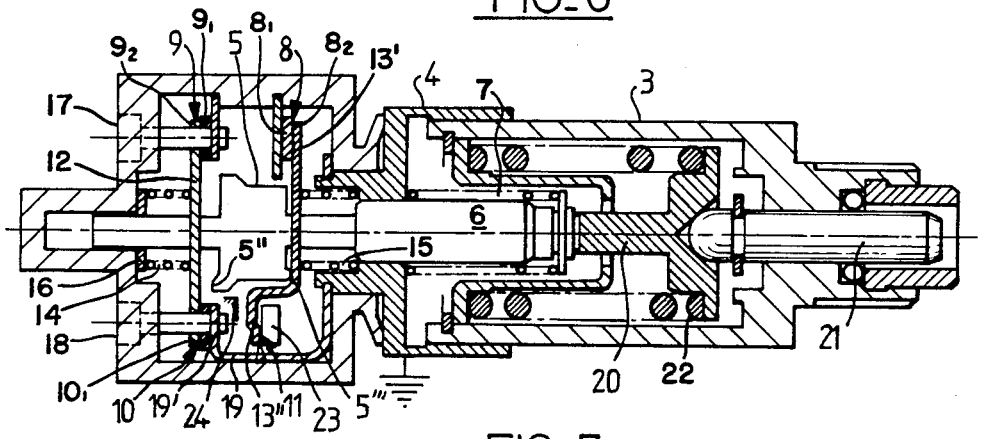
Figure 8:
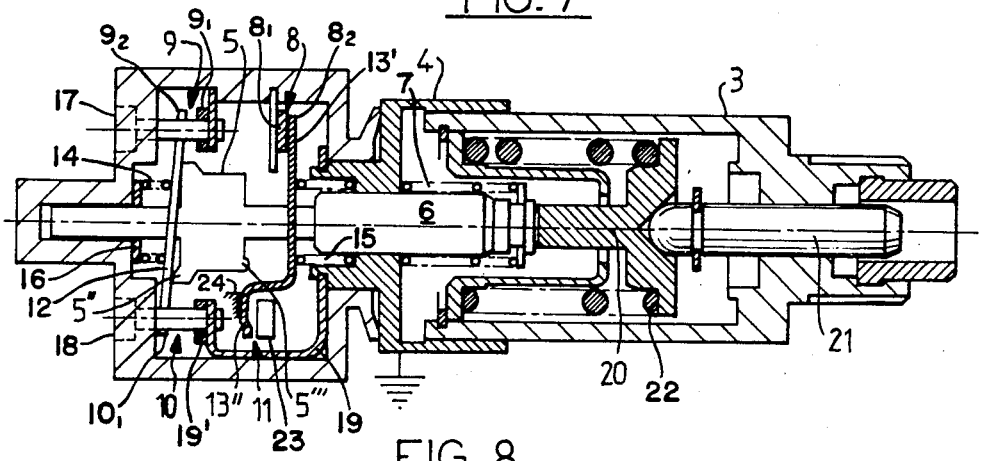
Figure 9:
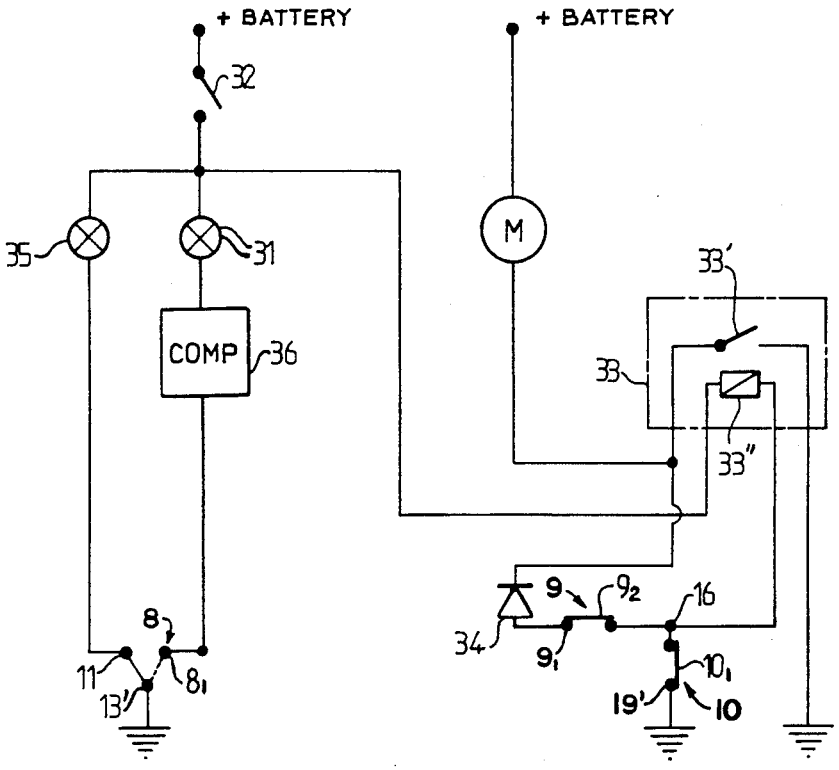
FIG. 9 shows a circuit similar to that of FIG. 5 and including the contactor of FIGS. 6 to 8.

According to the present invention, the switching on of the computer is informed to the driver in a much more perceptible way by means of the contactor of FIGS. 6 to 8, as included in the circuit of FIG. 9. This contactor enables the control of the powering of two signalling or alarm units rather than a single one, the power supply switching from one unit to the other as the pressure passes through the value $P_1$. Thus the transition is indicated by the emission of two different and successive positive signals, which are suitable for attracting the attention of an observer.

In most of their states the contactors of FIGS. 1 to 5 and 6 to 9 are identical or very similar. The following description will describe only the parts of the contactor of FIGS. 6 to 9 which do not occur again in the description of the contactor of FIGS. 1 to 5, the identical or very similar members of these two contactors also being marked with the same numerical references. Reference will be made to the above description of the contactor of FIGS. 1 to 5 with regard to these members of the contactor of FIGS. 6 to 9.

The latter is essentially distinguished from the preceding embodiment with regard to the shape of the bar 13' which replaces the bar 13 and the contacts associated with it. It will also be noted in FIG. 6 that a bearing surface 5''' of the control member pushes the bar 13, against the action of the spring 15 functioning in compression, in such a way as to prevent the closing of the pair of contacts 8.

According to the present invention, the bar 13' has one end contact 13'' shaped around a fixed contact 23 of the pair of contacts 13'' and 23 of contact pair 11, this end bearing on the left surface (from the point of view of FIGS. 6 to 8) of this fixed contact. Thus, in the position occupied by the bar 13' in FIG. 6, inclined to the axis of translation of the member 5, the pair of contacts $8_1$ and $8_2$ are open while the pair of contacts 13'' and 23 are closed. It will be noted that the line of action of the bearing surface 5''' on the bar 13' is vertically spaced (from the point of view of FIG. 1) from the line of action of the reaction of the contact 23 on the end contact 13'' of this bar. Thus there is applied to this bar 13' a couple oriented in the clockwise direction, which exceeds the force applied by the spring 15 on this bar, a force which would have tended to make the bar turn in the opposite direction, about an axis perpendicular to the plane of FIG. 1 and passing through the contact pair 11.

At the same time, the bar 12 closes the respective pairs of contacts 9 and 10 under the action of the spring 14 operating in compression, the control member 5 then being separated from the bar 12 in order to have no effect on it.

If, starting from the state of the contactor shown in FIG. 6, the pressure in the fluid which controls the axial position of the rod 21 increases, the piston 20 pushes the rod 6 which is integral with the control member 5 towards the left and this moves the bearing surface 5''' formed on the control member towards the left, the bar 13' then beginning to turn in the anticlockwise direction about the contact pair 11, under the thrust of the spring 15. With the pressure continuing to increase, the pair of contacts $8_1$ and $8_2$ close (FIG. 7), and, starting from this time, if the pressure continues to increase, the bar 13' pivots in the clockwise direction about an axis perpendicular at contact pair 8 to the axis 1, so that its other end contact 13'' separates, under the action of the spring 15, from the fixed contact 23 of the pair of contacts 13'' and 23, until these contacts are opened (see FIG. 8). This rotation of the bar 13' is stopped by a stop 24.

FIG. 7 therefore shows the contactor according to the invention at the moment of transistion between the closing of the contact pair 8 and the opening of the contact pair 11, which results in the switchover of the rotation of the bar 13' from one direction of rotation to the opposite direction. The effect of this switchover is to connect the contact pair 8 to ground through the bar 13' and the spring 15 and to break the connection of the fixed contact 23 of the pair of contacts 13'' and 23 with this same ground.

According to the invention, this switchover is used for switching off the power supply of a first element or electrical or electronic device and to switch on the power supply to a second element or electrical or electronic device, at the moment at which the pressure in a fluid, which determines the axial position of the control member 5, passes through a predetermined value. There will be described hereafter, with reference to FIG. 9, a fluid pressure regulation circuit which makes use of this feature of the contactor according to the present invention.

Reference is now made to FIG. 9 which shows a part of an electrical control circuit of a fluid pressure device which makes use of the contactor of FIGS. 6 to 8. In this figure, the various electrical contacts have been given the same numerical references as those appearing in FIGS. 6 to 8, this has been done to facilitate the understanding of the operation of the circuit. The fluid pressure device can be, for example, used to activate the brakes of a motor vehicle. Such a device includes a fluid circuit in which there is a pump driven by an electric motor M powered by the vehicle battery. According to an essential characteristic of the present invention, the device also includes two electrical elements 31 and 35 for signalling by sound and/or visual alarm, each connected in series with a switch 32 controlled by the ignition key of the vehicle, this switch being electrically connected to the vehicle battery. Pairs of contact pairs 8 and 11 define a changeover switch interposed between the signalling elements 31, 35 respectively and ground. A device 36, such as an electronic computer used in an anti-skid braking device for a motor vehicle, is placed in series with the display elements 31. This computer modulates the pressure in a circuit using a braking fluid forming part of the device.

The motor of the pump is controlled by a make-contact relay 33. The coil 33'' of the relay is connected on the one hand to the common point of the switch 32 and the signalling elements 31 and 35 and, on the other hand, to the common contact 16 of the contact pairs 9 and 10 defining break-contact switches. This part of the circuit is identical to the corresponding part of the circuit in FIG. 5 and will not be further described.

The circuit in FIG. 9, like that of FIG. 5, reacts to the passage of the pressure in the controlled fluid circuit through three pressure values $P_1$, $P_2$ and $P_3$, increasing in this order and corresponding with the switchings of pair of contacts 8, 11, 10 and 9 respectively.

According to the invention if, accidentally, the fluid pressure leaves the range ($P_2$, $P_3$) to drop again below $P_1$, for example due to a pump failure or a leak in the brake fluid circuit, the driver notices, as the pressure passes through the value $P_1$, not only the switching off of the emission of element 31 but also the start of an emission by the element 35. If these emissions are light emissions, it will be possible to provide different colors for the emissions of elements 31 and 35, constituted for example by electric light bulbs or light emitting diodes placed on the dashboard of a motor vehicle as light indicators. Thus, the driver will be informed of the drop in pressure to below the level $P_1$, with the switching off of the computer, by a positive signal that is easier to perceive than the simple disappearance of the signal emitted by the element 31, as was the case in the control circuit of FIG. 5. This arrangement improves the safety of the driver in that it enables him to be more surely alerted to the pressure drop in the braking circuit in order that he may react in consequence.

As mentioned for the contactor of FIGS. 1 to 4, it is possible to independently adjust the values $P_1$, $P_2$ and $P_3$ by adjusting the position of the contacts, for example using adjustment screws.

The contactor according to the invention accurately carries out several switchings, using a single contactor enabling a reduction in manufacturing costs.

The invention is, of course, not limited to the embodiment described and shown, which has been described only by way of example.

Thus, the respective sets of contact pairs 8, 11 and 9, 10 could be made completely independent from each other by making the conducting contact support bars from an electrically non-conducting material, and by providing, between these contact pairs and the connecting circuits, electrical links formed from flexible wires, for example.

Similarly, quantities other than a fluid pressure could be adjusted by a circuit including a contactor according to the invention. Several transducers well known to a specialist in the field enable the conversion of such a physical or electrical quantity, for example, into a displacement of the control member of the contactor.

We claim:

1. An electrical contactor of the type including a control member which moves in translation in order to pass through at least first, second and third positions each corresponding to a change of state of at least first, second, third and fourth pairs of electrical contacts which can be open or closed, first and second bars which carry first and second, and third and fourth electrical contacts respectively forming part of the first and second, and third and fourth pairs of contacts, the control member working in conjunction with the bars in order to make each of the bars turn about an axis of rotation perpendicular to an axis of translation of the control member in such a way that at each end of a rotational travel, each bar changes the state of one of the pairs of electrical contacts associated with the bar, characterized in that the control member (5) includes a monoblock part interposed between the first and second bars which are spring loaded toward each other and toward the monoblock part which includes at least two protruding bearing surfaces (5', 5'''; 5'') each placed facing one of the bars and laterally spaced from a fixed contact of an associated pair of contacts to make the associated bar swing through a rotational travel about an axis passing through said fixed contact so as to change the state of another pair of contacts controlled by said associated bar, the control member being movable between the first and second bars in order to sequentially move the bars so as to effect the changes of state of the four pairs of contacts, at ends of the rotational travels of the bars,. when the control member moves from one end to the other end of the member's translational travel.

2. The contactor according to claim 1, characterized in that one protruding bearing surface (5'') cooperates with an adjacent part of the control member in order to receive the second bar (12) in a fixed position with respect to the control member, so as to allow a translational displacement of the second bar beyond the rotational travel of the second bar (12).

3. The contactor according to claim 2, characterized in that the one protruding bearing surface (5'') protrudes axially from the control member in order to support the second bar (12) in a position inclined to the translation axis of the control member, beyond the rotational travel of the second bar.

4. The contactor according to claim 1, characterized in that the control member passes through first, second, and third successive positions on its translation axis, respectively corresponding to the closing of the contacts of two pairs (8, 11) of contacts forming a first make-contact electrical switch ($8_1$, 13, 19') and to the opening of the contacts of second (9) and third (10) break-contact switches.

5. The electrical contactor according to claim 1, characterized in that the first and second pairs of contacts include first and second fixed contacts on which a bar (13') abuts to rotate successively in first and second respective opposite directions of rotation about axes passing through the first and second fixed contacts, in order to change the state of the second and first pairs of contacts.

6. The contactor according to claim 17, characterized in that the first bar is electrically conducting and connected to ground through a coupling piece (4) of the contactor, the first bar (13') constituting with the first and second pairs of contacts (8, 11) a changeover switch connected to ground through the first bar.

7. The contactor according to claim 6, characterized in that the control member passes through first, second, and third successive positions on its translation axis, the first position corresponding with the closing of one (8) of the first and second pairs of contacts associated with the first bar (13') and with the opening of the other (11) of the first and second pairs of contacts, the second and third positions corresponding with a change of state of third and fourth pairs of contacts (9, 10) associated with the second bar (12).

8. The contactor according to claim 7, characterized in that the contacts of a respective bar are electrically connected with one another.

9. The contctor according to claim 8, characterized in. that the contactor includes means for adjusting change-of-state positions of the respective pairs of electrical contacts.

10. A fluid pressure regulating device comprising a pump driven by an electric motor, a circuit (33, 34) for controlling the supply of power to the motor, and a contactor according to claim 5, characterized in that axial positioning of the control member of the contactor is adjusted by the fluid pressure, and the associated two pairs of contacts (9, 10) of the second bar (12) are connected to said circuit (33, 34) and pressure-switch to control the supply of power to the motor in order to maintain the fluid pressure between two predetermined values ($P_2$, $P_3$).

11. The device according to claim 10, characterized in that two of said pairs of contacts form a switch (8, 11, 13') connected to an electrical power supply circuit for controlling a connection of said electrical power supply circuit to two electrical signalling elements (31, 35) designed to emit positive distinct signals, in order to switch the connection of the electrical power supply from one signalling element to the other signalling element when the fluid pressure passes through a preset value ($P_1$).

12. The device according to claim 11, and comprising a computer controlling the value of the fluid pressure in an operational circuit, characterized in that the switch (8, 11, 13') also controls operation of the computer when the fluid pressure deviates from the preset value ($P_1$).

* * * * *